US006172014B1

(12) United States Patent
Meyers

(10) Patent No.: US 6,172,014 B1
(45) Date of Patent: Jan. 9, 2001

(54) METHOD OF LUBRICATING COMPRESSION CYLINDERS USED IN THE MANUFACTURE OF HIGH-PRESSURE POLYETHYLENE

(75) Inventor: Douglas Meyers, Houston, TX (US)

(73) Assignee: Pennzoil-Quaker State, The Woodlands, TX (US)

( * ) Notice: Under 35 U.S.C. 154(b), the term of this patent shall be extended for 0 days.

(21) Appl. No.: 09/343,188

(22) Filed: Jun. 30, 1999

Related U.S. Application Data

(60) Provisional application No. 60/091,307, filed on Jun. 30, 1998.

(51) Int. Cl.[7] ..... C10M 137/12

(52) U.S. Cl. ..... 508/442; 508/441; 508/545; 508/584

(58) Field of Search ..... 508/442, 563

(56) References Cited

U.S. PATENT DOCUMENTS

| | | | | |
|---|---|---|---|---|
| 4,116,877 | * | 9/1978 | Outten et al. | 252/72 |
| 4,652,385 | * | 3/1987 | Cohen | 252/48.6 |
| 4,654,154 | * | 3/1987 | Wikelski et al. | 252/11 |
| 5,059,662 | * | 10/1991 | Wikelski et al. | 526/208 |
| 5,102,567 | * | 4/1992 | Wolf | 252/46.6 |
| 5,595,963 | * | 1/1997 | Puckace et al. | 508/421 |
| 5,955,403 | * | 9/1999 | Wong | 508/282 |

OTHER PUBLICATIONS

"Advanced Elastic Analysis of Compressor Cylinders for H.P. Low Density Polyethylene Production: High Pressure Ethylene Compressor (Figure 2)", Nuovo Pignone, vol. 48, p. 84.

"PE Hyper Compressors."

"High Pressure Polyethylene (PE) Process."

"Some Investigations on the Behavior of High Pressure Packings Used In Secondary Compressors For Low Density Polyethylene Production: PE Hyper Compressor Detail (Figure 1", International Conference on High Pressure Engineering, 2nd Edition, 1975, University of Sussex, p. 165. Photograph, C. Lee Cook.

"Problems of Hyper Compressors."

"Lubrication of Compression Cylinders Used In the Manufacture of High–Pressure Polyethylene", by Karl W. Wikelski, Journal of the American Society of Lubrication Engineers, vol. 37, No. 4, pp. 203–208.

* cited by examiner

*Primary Examiner*—Ellen M. McAvoy
(74) *Attorney, Agent, or Firm*—McDermott, Will & Emery

(57) ABSTRACT

Disclosed is an improved method of reducing compressor gas leakage by providing a compression cylinder with a lubricant comprising less than about 1% of a synergistic mixture of antioxidants.

16 Claims, No Drawings

METHOD OF LUBRICATING COMPRESSION CYLINDERS USED IN THE MANUFACTURE OF HIGH-PRESSURE POLYETHYLENE

RELATED APPLICATIONS

This application claims priority from U.S. Provisional Patent Application Ser. No. 60/091,307, filed Jun. 30, 1998, which is incorporated herein by reference.

TECHNICAL FIELD

The present invention relates to a method of reducing compressor gas leakage by providing a compression cylinder with a lubricant comprising less than about 1% of a synergistic mixture of antioxidants.

BACKGROUND ART

The escalating requirements for lubricants used in compression cylinders associated with the dynamic sealing of ethylene within the compressor cylinder and the hydraulic fatigue of pressure containing components subjected to cyclic pressures is considered one of the most demanding aspects of high-pressure manufacture of polyethylene. These aspects are discussed in more detail in *Lubrication Engineering*, Volume 37, 4, 203–208 (1981). High demands for large scale production require increasingly improved lubricants. This objective becomes particularly difficult to achieve given the sophisticated and capital-intensive nature of the process and challenges the limitations of polyethylene manufacture. Thus, the combined requirements of high-pressure equipment and cylinder life pose a challenge which, to date, has not been satisfactorily achieved.

U.S. Pat. No. 4,654,154 to Wilkelski discloses a conventional method of reducing cylinder gas leakage from compressors used in high pressure olefin polymerization processes wherein from about 3 to about 10 wt % of an antioxidant is added to the lubricating fluid provided to a compressor cylinder. Wilkelski discloses that the problem of increased gas leakage is due to an oxidation reaction occurring in the narrow annular passageway between the plunger and the cylinder packing.

The oxidation can take place due to the presence of unreacted peroxide initiators in the recycled ethylene and/or the introduction of a polymerization initiator, that is, oxygen gas to the ethylene before compression. The unwanted oxidation leads to undesirable consequences including buildup of excessive heat, high pressures and resultant high mechanical stress.

Despite the benefits achieved by the Wilkelski method, the provision of the additional antioxidant forces the cost of practicing the method upwards, thereby adversely affecting the commercial viability of the process.

There exists a need to provide an efficient and cost-effective technique to satisfy the demands of high-pressure polyolefin manufacture.

DISCLOSURE OF THE INVENTION

An object of the present invention is a method of reducing compressor gas leakage comprising the step of: providing a compression cylinder with a lubricant comprising less than about 1.0 wt % of an antioxidant.

Additional objects and advantages of the present invention will be set forth in part in the description which follows and in part will become apparent to those having ordinary skill in the art upon examination of the following or may be learned from the practice of the invention. The objects and advantages of the invention may be realized and obtained as particularly pointed out in the appended claims.

According to the present invention, the foregoing and other objects are achieved in part by a composition comprising a lubricant, and at least two antioxidants, wherein the antioxidants are present in an amount less than about 1 wt %, based on the total weight of the composition, and wherein the composition reduces cylinder gas leakage from a compressor used in high pressure olefin polymerization and increases time intervals between replacement of worn cylinder assemblies.

Additional objects and advantages of the present invention will become readily apparent to those having ordinary skill in this art from the following detailed description, wherein only the preferred embodiment of the invention is shown and described, simply by way of illustration of the best mode contemplated for carrying out the invention. As will be realized, the invention is capable of other and different embodiments, and its several details are capable of modifications in various obvious respects, all without departing from the invention. Accordingly, the drawings and description are to be regarded as illustrative in nature, and not as restrictive.

DESCRIPTION OF THE INVENTION

The present invention addresses and solves problems stemming from the use of unnecessarily high amounts of costly antioxidants in connection with lubricating compression cylinders used in high pressure olefin polymerization processes.

In particular, the present invention is based, in part, on the surprising and unexpected discovery that equal or improved lubricant stability may be achieved at much lower levels of antioxidant through the use of synergistic mixtures of antioxidants comprising different blends of phosphite antioxidants, hindered phenols, and secondary amines. Numerous practical advantages in handling the smaller volume of solids stem from the present invention, and include less costly equipment for handling and less time required for batch preparation.

The lubricant component of the present invention may be any commercially available compound known to perform as a cylinder lubricant in a high pressure compressor for providing olefin feed to a polymerization zone. Examples include mineral oils and especially white mineral oils of 250 to 1200 SUS viscosity. The white mineral oils may also be combined with a polymeric thickener such as polybutene to adjust the viscosity to the desired level.

The antioxidant component of the present invention may be any antioxidants known to those of ordinary skill in the art. Examples include antioxidants comprising phosphite compounds and aminic and phenolic antioxidants.

An antioxidant of the present invention may be a phosphite antioxidant, for example, a phosphite antioxidant selected from the group consisting of trinonylphenyl phosphite, tris-tert-butylphenyl phosphite, tridecylphosphite, triphenylphosphite, trioctylphosphite, alkylphenylphosphites, and dilaurylphosphite. Preferred phosphite antioxidants include tris(2,4-di-tert-alkylphenyl) phosphite, more preferably tris(2,4-di-tert-butylphenyl) phosphite. The term "alkyl" is used throughout the present specification to mean an unbranched or a branched alkyl chain having from 1 to 8 carbon atoms. The amount of phosphite antioxidant characteristically present in the composition are critical high oxidation induction values and the total amount of antioxidant present does not exceed about 1 wt %, based on the total weight of the composition. A preferred tris(2,4-di-tert-butylphenyl)phosphite is Irgafos 168 sold commercially by Ciba-Geigy under that name.

Another example of an oxidant which may be useful in the present invention is a phenolic antioxidant. Preferred phenolic antioxidants are hindered phenols such as thiodiethylene bis(3,5-di-tert-alkyl-4-hydroxyhydrocinnamates, more preferably thiodiethylene bis(3,5-di-tert-butyl-4-hydroxyhydrocinnamate which is sold commercially under the name Irganox 1035 by Ciba-Geigy, and tetrakis [methylene(3,5-di-tert-alkyl-4-hydroxyhydrocinnamate)] methanes, more preferably tetrakis[methylene(3,5-di-tert-butyl-4-hydroxyhydrocinnamate)] methane is sold commercially under the name Irganox 1010 by Ciba-Geigy. Another example of a hindered phenol useful in the present invention is butylated hydroxytoluene (BHT). The amount of phenolic antioxidant characteristically present in the composition is not particularly critical so long as the total amount of antioxidant present does not exceed about 1 wt %, based on the total weight of the composition.

A further example of an oxidant which may be useful in the present invention is an aminic antioxidant. Preferred aminic antioxidants include secondary aromatic amines such as diarylamines, e.g., diphenylamine, and modifieddiarylamines, e.g., N-phenyl-g-naphthylamine, p-isopropoxydiphenylamine, mono and dioctyldiphenylamine, bis-diarylamines and modified bisdiarylamines, such as N,N-diphenyl-p-phenyldiamine. The amount of aminic antioxidant characteristically present in the composition is not particularly critical so long as the total amount of antioxidant present does not exceed about 1 wt %, based on the total weight of the composition.

An especially preferred antioxidant is a blend of aminic and phenolic antioxidants, that is, a liquid blend of thiodiethylene bis(3,5-di-tert-butyl-4-hydroxyhydrocinnamate, tetrakis[methylene(3,5-di-tert-but-hydroxyhydrocinnamate)] methane and alkylated diarylamines from the reaction products of 2,4,4-trimethylpentene and N-phenylbenzenamine, Irganox L 150, sold commercially by Ciba-Geigy under that name.

The antioxidant additives are present in the lubricant composition in an amount less than about 1 wt %, based on the total weight of the composition. Characteristically, the antioxidant additives are present in a range of about 0.4 to about 1.2 wt percent, preferably about 0.5 to about 1.1 wt percent, most preferably about 0.5 to about 1.0 wt percent.

The compositions of the present invention may further comprise other conventional lubricant additives, for example, thickeners such as polybutene Indopol H-1900, antiwear additives such as oleic acid and AMP, an amine phosphate wear additive, Irgalube 349 sold commercially by Ciba-Geigy under that name.

While the present compositions are disclosed generally above, additional embodiments are further discussed and illustrated with reference to the examples below. However, the examples are presented merely to illustrate the invention and are not considered as limitations thereto.

EXAMPLE 1

To demonstrate the efficacy of the antioxidant compositions according to the present invention, the oxidation stability was evaluated by pressure differential scanning calorimetry (DSC) at 175° C. and 500 psi oxygen. The results are shown in Table 1.

TABLE 1

Compressor Lubricant Oxidation Stability by DSC
Differential Scanning Calorimetry (DSC) at 175° C. and 500 psi Oxygen

| No. | Lubricant Viscosity[a] and Added Antioxidants | Oxidation Induct. Time, Min. @ 175° C. |
|---|---|---|
| 1 | 800 SUS Lubricant + 3.0% Oleic Acid[b] + 0.15% L-150[c] | 4.4 |
| 2 | 800 SUS Lubricant + 0.5% AMP[d] + 0.15% L-150 | 5.8 |
| 3 | 800 SUS Base White Oil + Indopol H-1900 Thickener[a] | 6.4 |
| 4 | 400 SUS Lubricant + 0.5% AMP + 0.15% L-150 | 6.6 |
| 5 | 600 SUS Lubricant + 3% Oleic Acid[b] + 750 ppm BHT[c] | 7.5 |
| 6 | 100 SUS Base White Oil + Indopol H-1900 Thickener | 7.5 |
| 7 | 1000 SUS Lubricant + 3% Oleic Acid + 750 ppm BHT | 7.5 |
| 8 | 540 SUS Base White Oil | 8.2 |
| 9 | 1200 SUS Lubricant + 0.5% AMP[d] + 1000 ppm BHT | 9.8 |
| 10 | 1000 SUS Lubricant + 0.5% AMP + 750 ppm BHT | 9.8 |
| 11 | 800 SUS Oil + 0.5% AMP[d] + 0.15% Irganox 1035[f] + 0.4% Irgafos 168[g] | 16.4 |
| 12 | 800 SUS Lubricant + 0.5% AMP + 0.14% Irganox 1010[h] + 0.4% Irgafos 168 | 18.6 |
| 13 | 600 SUS Lubricant + 3% Oleic Acid + 4% BHT | 20.8 |
| 14 | 800 SUS Lubricant + 0.5% AMP + 0.14% Irganox 1010 + 0.4% Irgafos 168 | 21.0 |
| 15 | 1500 800 SUS Lubricant + 0.5% AMP + 0.5% Irganox 1035 | 21.3 |
| 16 | 800 SUS Lubricant + 0.5% AMP[d] 0.8% L-150 + 0.24% Irgafos 168 | 21.4 |
| 17 | 600 SUS Libricant + 3% Oleic Acid[b] + 0.15% Irganox L-150 + 0.5% Irgafos 168 | 22.7 |
| 18 | 400 SUS Lubricant + 0.50% AMP[d] + 0.08% Irganox L-150 + 0.24% Irgafos 168 | 31.1 |
| 19 | 800 SUS Lubricant + 0.5% AMP[d] + 0.15% Irganox L-150 + 0.40% Irgafos 168 | 35.0 |
| 20 | 1500 SUS Lubricant + 0.5% AMP[d] + 0.33% Irganox L-150 | 37.0 |
| 21 | 800 SUS Lubricant + 0.5% AMP[d] + 0.15% L-150 + 0.5% Irgafos 168 | 50.4 |
| 22 | 600 SUS Lubricant + 0.5% AMP[d] + 0.15% L-150 + 0.5% Irgafos | 54.0 |

TABLE 1-continued

Compressor Lubricant Oxidation Stability by DSC
Differential Scanning Calorimetry (DSC) at 175° C. and 500 psi Oxygen

| No. | Lubricant Viscosity[a] and Added Antioxidants | Oxidation Induct. Time, Min. @ 175° C. |
|---|---|---|
| | 168[f] | |
| 23 | 1000 SUS Lubricant + 0.5% AMP[d] + 0.15% L-150 + 0.5% Irgafos 168 | 53.5 |
| 24 | 1200 SUS Lubricant + 0.5% AMP[d] + 0.33% Irganox L-150 + 0.5% Irgafos 168 | 65.0 |

[a] Oil viscosities are SUS at 100° F. All lubricants contain USP White oils as base with polybutene Indopol H-1900 as thickener.
[b] Oleic acid is antiwear additive.
[c] Irganox L-150, an antioxidant liquid blend from Ciba consisting of Irganox L-57 secondary amine antioxidant plus Irganox 1010, and Irganox 1035, hindered phenolic antioxidants.
[d] AMP is Irgalube 349, an amine phosphate wear additive from Ciba
[e] BHT is butylated hyroxytoluene, hindered phenolic antioxidant
[f] Irganox 1035, hindered phenolic antioxidant from Ciba
[g] Irgafos 168, aryl phosphite antioxidant from Ciba
[h] Irganox 1010, hindered phenolic antioxidant from Ciba

TABLE 2

Block-On-Ring Wear Test Results for Oxidation Inhibitor Oils

| | 780-48-2 | 780-48-3 | 780-49-1 | 780-49-2 | 780-49-3 | Run 115 | Run 113 | 715-89-600 | 715-89-1000 |
|---|---|---|---|---|---|---|---|---|---|
| Vis SUS @ 100° F. | 800 | 400 | 800 | 400 | 800 | 1000 | 1000 | 600 | 1000 |
| Identity in Table 1 | No. 16 | No. 18 | No. 2 | No. 4 | No. 1 | No. 10 | No. 7 | No. 22 | No. 23 |
| BHT, ppm | | | | | | 750 | 750 | | |
| Irgalube 349 | 0.50 | 0.50 | 0.50 | 0.50 | — | 0.5 | — | 0.50 | 0.5 |
| Irganox L-150 | 0.08 | 0.08 | 0.15 | 0.15 | 0.15 | — | — | 0.15 | 0.15 |
| Irgafos 168 | 0.24 | 0.24 | — | — | — | — | — | 0.50 | 0.50 |
| Oleic Acid | — | — | — | — | 3.0 | — | 3.0 | — | — |
| Block-on-Ring[a] | | | | | | | | | |
| Scar, mm | 0.70 | 0.60 | 0.70 | 0.70 | 0.70 | 0.80 | 0.95 | 0.60 | 0.60 |
| $\mu$, friction coefficient | 0.037 | 0.037 | 0.036 | 0.038 | 0.04 | 0.03 | 0.02 | 0.03 | 0.04 |
| Block w/loss, mg | 0.3 | 0.2 | 0.1 | 0.2 | 0.2 | 0.01 | 1.15 | 0.00 | 0.1 |
| DSC @ 175° C., Min. Oxidation Induction Time[b] | 21.4 | 31.1 | 5.8 | 6.6 | 4.4 | 9.8 | 7.5 | 54 | 53.5 |

[a] ASTM G77, Modified Test Conditions: 210° F., 750 rpm, 200 lb load, 20,000 cycles; 2 min break-in at 30 lb load Kennametal KZ 94 tungsten carbide rings with 1 microinch average roughness. CDA copper alloy No. C93800 bronze block.
[b] Differential Scanning Calorimetry (DSC) at 175° C. and 500 psi oxygen; general procedure described in ASTM D-5483.

Table 2 is a summary of matching metallurgy wear tests with corresponding DSC data from Table 1. Cross references are given in Table 2 for referring back to Table 1. A word about the importance of using matching metallurgy in the bench wear test: the sealing elements in the compressors are the polished Kenemetal KZ 94 tungsten carbide plungers and special bronze packing rings. We used CDA 938 bronze because this type of bronze is the choice of several polyethylene manufacturers. Both the elements (rings and bronze blocks) were obtained from the industry suppliers of plungers and bronze seal rings.

It should be noted that formulations using the prior art give a DSC oxidation time of 20.8 minutes, see example 13 in Table 1. By adding phosphite and other antioxidants, oxidation inhibition is enhanced for all formulations containing the L-150 antioxidant blend and Irgafos 168 (at much lower total antioxidant levels).

Especially dramatic are the results when one compares the oxidation induction times of the following lubricants in Table 1: #2 and #4 versus #22 and #23. Only 0.5 wt % Irgafos 168 improves the oxidation stability by almost a factor of 10. In example 24 (0.83% total antioxidant) of Table 1, the oxidation induction time is 65 minutes compared to reference example #13 where the BHT total antioxidant level is 4%.

In Table 2, we note that better wear results were obtained with the new antioxidant packages.

Only the preferred embodiment of the invention and an example of its versatility is shown and described in the present disclosure. It is to be understood that the invention is capable of use in various other combinations and environments and is capable of changes or modifications within the scope of the inventive concept as expressed herein.

What is claimed is:

1. A method of reducing compressor gas leakage comprising the step of:

providing a compression cylinder with a lubricant comprising less than about 1 wt % of an antioxidant mixture, wherein the antioxidant mixture comprises at least one phosphite antioxidant and at least one second antioxidant.

2. The method of claim 1, wherein the phosphite antioxidant is selected from the group consisting of trinonylphenyl phosphite, tris-tert-butylphenyl phosphite, tridecylphosphite, triphenylphosphite, trioctylphosphite, alkylphenylphosphite, tris(alkylphenyl)phosphite and dilaurylphosphite.

3. The method of claim 2, wherein the second antioxidant is selected from the group consisting of amine compounds, phenolic compounds, and mixtures thereof.

4. The method of claim 3, wherein the second antioxidant comprises a blend of a secondary amine antioxidant and a hindered phenolic antioxidant.

5. The method of claim 3, wherein the phosphite antioxidant comprises at least one aryl phosphite antioxidant.

6. The method of claim 3, wherein the second antioxidant comprises a phenolic antioxidant.

7. A method of reducing compressor gas leakage from a compressor used in high pressure olefin polymerization, the method comprising:

providing a lubricant composition to a compression cylinder of the compressor, wherein the lubricant composition comprises at least one phosphite antioxidant and at least one second antioxidant and wherein the total antioxidants present are in a range of about 0.4 to about 1.2 wt %, based on the total weight of the lubricant composition.

8. The method of claim 7, wherein the second antioxidant comprises a phenolic antioxidant and an amine antioxidant.

9. The method of claim 7, wherein the phosphite antioxidant comprises at least one aryl phosphite antioxidant.

10. The method of claim 7, wherein the phosphite antioxidant comprises at least one aryl phosphite antioxidant and the second antioxidant comprises a hindered phenolic antioxidant.

11. The method of claim 7, wherein the total antioxidants present are in a range of about 0.5 to about 1.0 wt %.

12. The method of claim 7, wherein the lubricant composition further comprises one or more of a thickener, or an antiwear additive.

13. A composition that reduces cylinder gas leakage from a compressor used in high pressure olefin polymerization and increases time intervals between replacement of worn cylinder assemblies comprising:

a lubricant; and antioxidants, wherein the antioxidants comprise at least one phosphite antioxidant, at least one amine antioxidant, and at least one phenolic antioxidant and wherein the total antioxidants present are in a range of about 0.4 to about 1.2 wt %, based on the total weight of the composition.

14. The composition of claim 13, wherein the antioxidants comprise an aryl phosphite antioxidant, a secondary amine antioxidant and a hindered phenolic antioxidant.

15. The composition of claim 13, wherein the total antioxidants present are in a range of about 0.5 to about 1.0 wt %.

16. The composition of claim 13, wherein the total antioxidants present are in an amount less than about 0.5 wt %.

* * * * *